US005660292A

United States Patent [19]

Scholfield

[11] Patent Number: 5,660,292

[45] Date of Patent: Aug. 26, 1997

[54] CUP HAVING IMPROVED HANDLE

[76] Inventor: Richard Scholfield, 4608 Eastlake Cir., Sarasota, Fla. 34232

[21] Appl. No.: 207,615

[22] Filed: Mar. 9, 1994

[51] Int. Cl.[6] ..... B65D 25/26

[52] U.S. Cl. ..... 220/212.5; 220/710.5; 220/636; 220/630; 220/753; 220/755; 220/756; 220/771

[58] Field of Search ..... 220/215, 636, 220/753, 755, 212, 212.5, 756, 771, 752, 710.5, 630

[56] References Cited

U.S. PATENT DOCUMENTS

| | | | |
|---|---|---|---|
| D. 160,567 | 10/1950 | Wylie | 220/710.5 |
| 1,546,131 | 7/1925 | Hechler | 220/753 |
| 2,527,447 | 10/1950 | Perl | 220/753 |
| 2,540,306 | 2/1951 | Turek | 220/753 |
| 2,961,122 | 11/1960 | Shigo | 220/750 |
| 3,927,797 | 12/1975 | Flider | 220/772 |
| 4,907,719 | 3/1990 | Spotholz et al. | 220/752 |
| 5,054,638 | 10/1991 | Rosg | 220/752 |
| 5,307,950 | 5/1994 | Li | 220/710.5 |

*Primary Examiner*—Joseph M. Moy

*Attorney, Agent, or Firm*—Cushman Darby & Cushman Intellectual Property Group of Pillsbury Madison & Sutro, LLP

[57] ABSTRACT

A cup is provided including a generally cylindrical reservoir member having distal and proximal ends and a sidewall disposed between the ends, the distal end defining a bottom surface of the reservoir member, the proximal end defining an opening in the reservoir member. A handle structure is affixed to sidewall. The handle structure includes opposing first and second generally horizontal portions fixed to and extending from the sidewall structure, the first portion being joined with the second portion. The handle structure also includes a substantially vertical plate affixed to the horizontal portions so that the vertical plate is disposed therebetween, the vertical plate being disposed between the sidewall and the vertical member such that a lateral distance from the vertical plate to the sidewall is less than a lateral distance from the vertical plate to the vertical member, so as to isolate the user's fingers from contact with the sidewall.

19 Claims, 6 Drawing Sheets

CUP HAVING IMPROVED HANDLE

BACKGROUND OF THE INVENTION

This invention relates to containers for housing a liquid at an elevated temperature, and more particularly, to a cup having an improved handle.

Conventional cups or mugs include a generally U-shaped handle having curved surfaces. The handle is typically arranged so each end of the handle extends directly from the sidewall surface of the cup and is spaced therefrom to enable the user's fingers to grip the handle. However, the handle is typically spaced from the cup in a manner such that a user's fingers may contact the outer surface of the cup while gripping the handle. These handles are undesirable since typically, such cups contain liquid, such as coffee or tea, at an elevated temperature. Thus, when gripping the handle, the user may contact the hot outer surface of the cup and react by spilling the contents of the cup or not being able to conveniently hold the cup. The user may even receive a burn as a result of contacting the hot surface of the cup.

Conventional cup handles are typically of narrow width and are steeply curved, thereby making them difficult to grip and control in all directions, especially for those who are physically handicapped. For example, it is virtually impossible for persons having missing fingers or a thumb to grip and lift a conventional cup without spilling the contents thereof. Further, since a strong grip is required to hold a conventional cup by its handle, it is difficult for an arthritic person to use such a cup.

SUMMARY OF THE INVENTION

It is an object of the invention to provide a cup having a handle whereby a user's fingers may be isolated from the outer peripheral surface of the cup, while holding the cup. Another object of the invention is to provide a cup having a handle whereby users having physical handicaps may be able to easily grip and lift the cup without spilling its contents.

In accordance with the principles of the present invention, these objectives are obtained by providing a cup including a generally cylindrical reservoir member having distal and proximal ends and a sidewall disposed between the ends, the distal end defining a bottom surface of the reservoir member, the proximal end defining an opening in the reservoir member. A handle structure is affixed to sidewall. The handle structure includes opposing first and second generally horizontal portions fixed to and extending from the sidewall structure, the first portion being joined with the second portion. The handle structure also includes a substantially vertical plate affixed to the horizontal portions so that the vertical plate is disposed therebetween, the vertical plate being disposed between the sidewall and the vertical member such that a lateral distance from the vertical plate to the sidewall is less than a lateral distance from the vertical plate to the vertical member, so as to isolate the user's fingers from contact with the sidewall.

A substantially horizontal plate is coupled to the vertical plate and the vertical member and disposed between the horizontal portions to be used in conjunction with the horizontal portions to aid in lifting the cup.

In accordance with another aspect of the invention, a cover member is provided for engaging at least one end of a cup. The cover member includes a base, a portion extending from the base having an open end, an inner periphery of the portion of the cover member being larger than an outer periphery of the cup so that at least a part of the cup may be received in the portion of the cover member. The portion of the cover member includes surfaces defining a notch therein for receiving a portion of a handle of the cup. The cover member is constructed and arranged to engage at least one end of the cup when the portion of the handle extends within the notch portion.

Other objects, features and characteristics of the present invention, as well as the methods of operation and the functions of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE PRESENTLY PREFERRED EXEMPLARY EMBODIMENT

Figure 1:
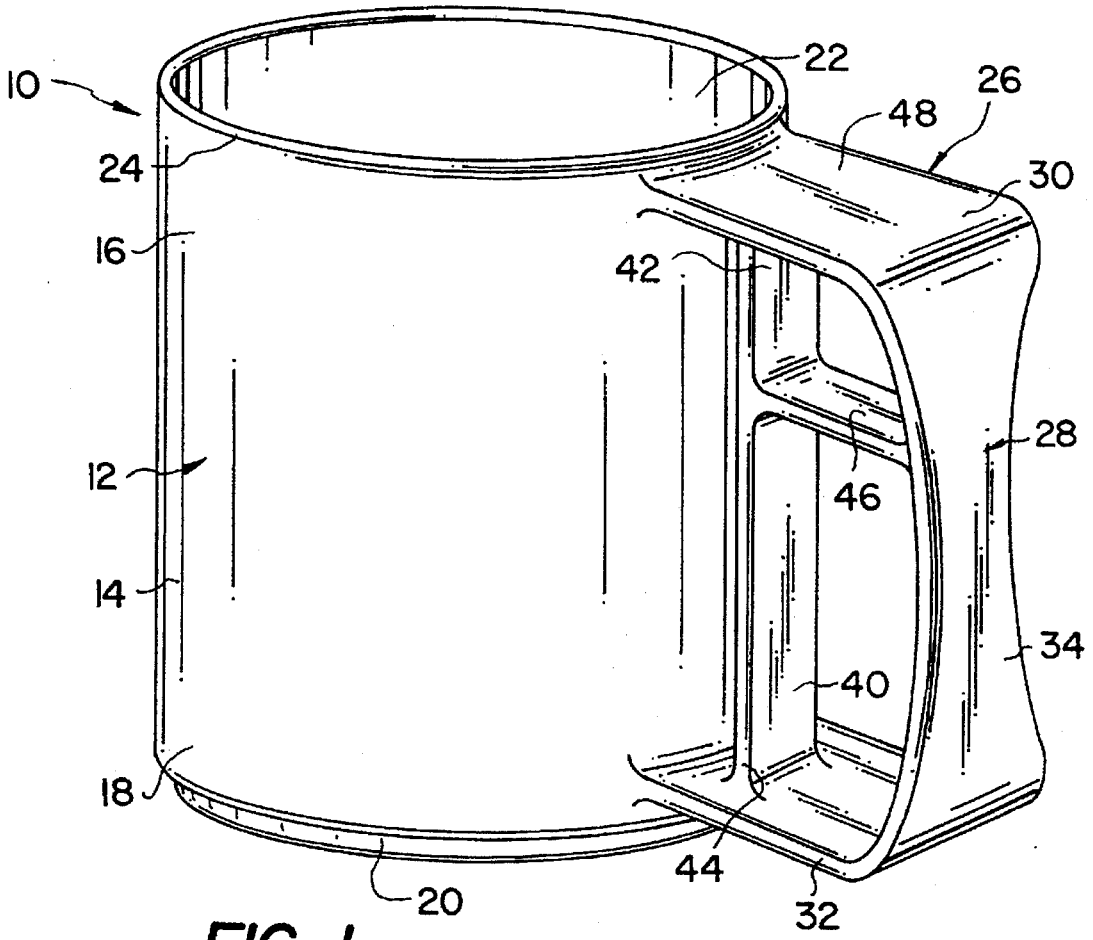
FIG. 1 is a perspective view of a cup constructed in accordance with the principles of the present invention.

Referring to FIG. 1, a cup is shown for housing liquid or the like, generally indicated at 10, which embodies the principles of the present invention. Cup 10 includes a reservoir member 12 having a distal end 14 and a proximal end 16 with sidewall structure 18 disposed between the distal and proximal ends. The distal end 14 defines a bottom surface 20 of the reservoir member 12 while the proximal end 16 defines an opening 22 for the entry of a liquid or the like into the reservoir member 12. The proximal end 16 terminates at rim 24. The reservoir member 12 preferably has a capacity to contain, for example, 12 ounces of liquid, but greater and smaller volumes are contemplated as well. Member 12, as shown, is cylindrical but it should be understood that other cross-sectional shapes could also be used including a square, an oval, or other multi-sided configurations such as octagonal and hexagonal.

Figure 7:
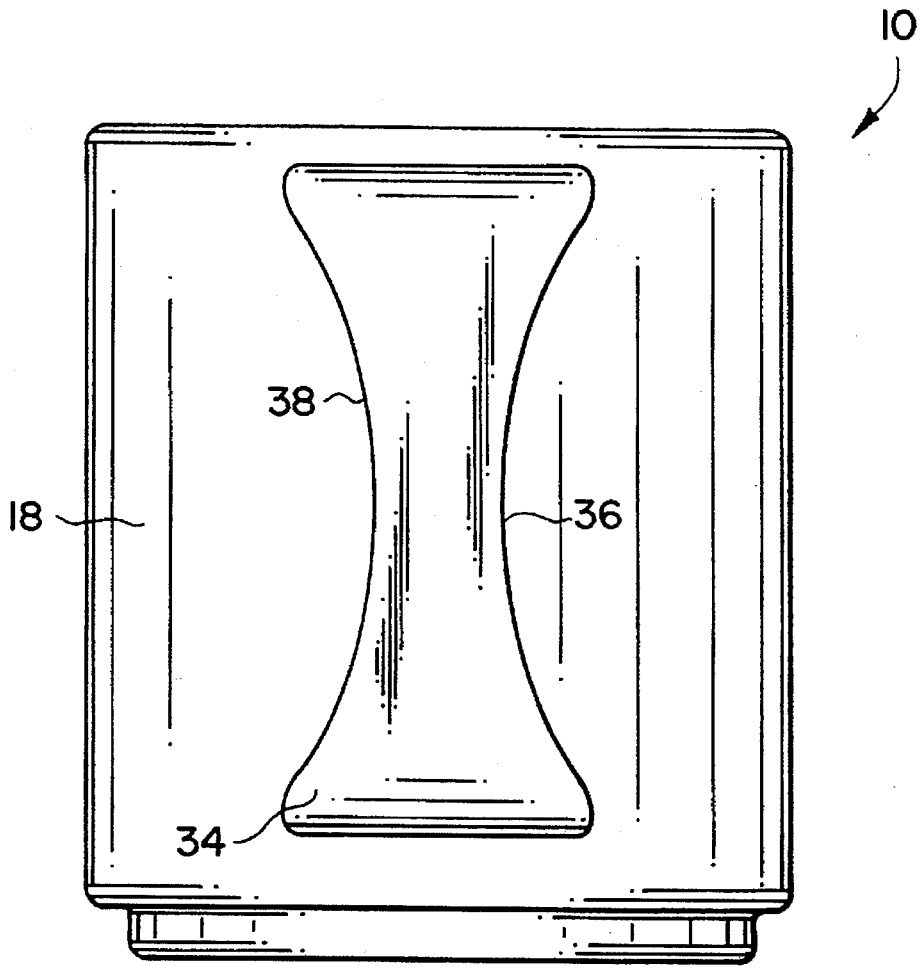
FIG. 7 is a side elevation of the handle structure of the cup provided in accordance with the invention.

The cup 10 includes a handle structure, generally indicated at 26, fixed to the sidewall 18. In the illustrated embodiment, the handle structure 26 includes a generally U-shape member 28 having an upper horizontal member 30 and an opposing lower horizontal member 32, each extending from the sidewall 18 with a generally vertical member 34 joining the ends of the horizontal members 30, 32 at a position spaced from the sidewall 18. In the illustrated embodiment, the horizontal members extend from the sidewall 18 approximately 1.5 inches and have a width of approximately 1.25 inches, the function of which will become apparent below. As the side elevation of the handle structure shown in FIG. 7 demonstrates, the vertical member 34 has an hour-glass shape with opposing arcuate outer surfaces 36, 38 that curve between horizontal members 30 and 32. Thus, the width of the vertical member 34 gradually tapers from the juncture of both horizontal members toward a central portion thereof. The arcuate outer surfaces 36, 38 facilitate gripping and balancing of the cup due to a better fit with the user's hand. This is especially so for users who have difficulty holding onto relatively small or thin handles.

Figure 2:
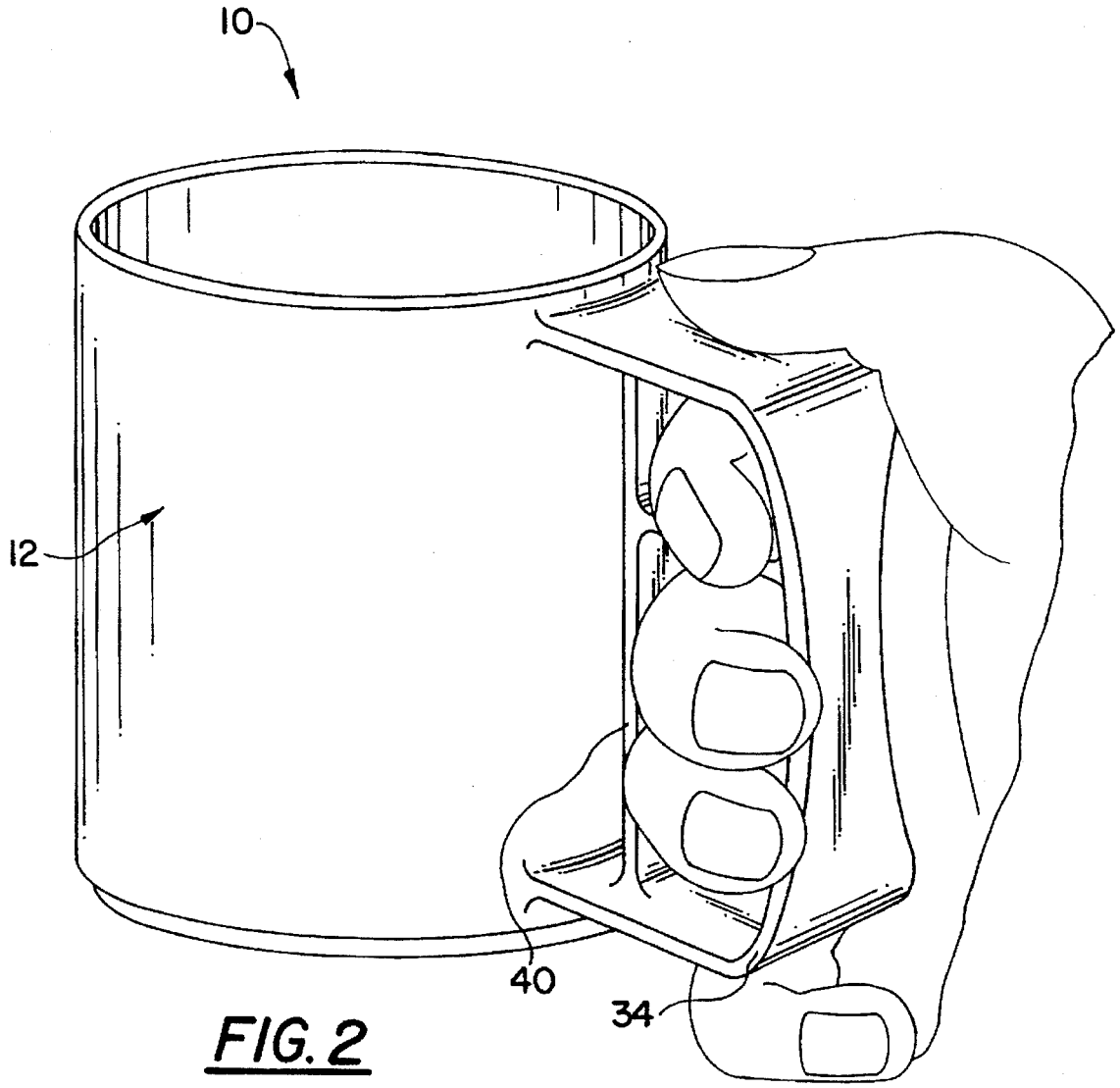
FIG. 2 is a perspective view of the cup of FIG. 1 shown being grasped by a user.

The handle structure 26 further includes a vertical plate 40 having a first end 42 and a second end 44. The first end 42 is coupled to the upper horizontal member 30 while the second end 44 of the vertical plate 40 is affixed to the lower horizontal member 32. As shown in FIG. 1, the vertical plate 40 is disposed between the sidewall 18 of the reservoir member 12 and the vertical member 34 of the handle structure 26. The vertical plate 40 is disposed closer to the sidewall 18 than to the vertical member 34. Thus, a user's fingers may be disposed between the vertical plate 40 and the vertical member 34 of the handle structure 26. Further, as shown in FIG. 2, the vertical plate 40 isolates the user's fingers from contact with the sidewall 18 which may become extremely hot due to the contents of the reservoir member 12.

In the illustrated embodiment, the handle structure 26 includes a horizontal plate 46 affixed between the vertical member 34 and the vertical plate 34. The horizontal plate 46 preferably has a width of approximately one-half inch, which is preferably equal to the width of the vertical plate 40. The horizontal plate 46 is disposed so as to be closer to the upper horizontal plate 30 than to the lower horizontal plate 32. Thus, when handling or gripping the cup 10, the user may insert his index finger through the space defined by the bounds of the upper horizontal member 30, the horizontal plate 46, the vertical plate 40 and vertical member 34, while two other fingers may be disposed in the space defined by the bounds of the lower horizontal member 32, the horizontal plate 46, the vertical plate and the vertical member 34, as shown in FIG. 2. The upper horizontal member 30 defines a planar surface 48 for resting the user's thumb to enhance lifting and balancing the cup 10. The lower horizontal member 32 has a similar planar surface. The horizontal plate also provides a surface for lifting. For example, a handicapped user having only a thumb and finger may lift the cup 10 by placing the thumb on the planar surface 48 of the upper horizontal member 30 and placing the finger so as to contact the underside of the horizontal plate 46.

The arcuate surfaces 36 and 38 of the vertical member 34 provide horizontal tilt control of the cup 10, since the shape facilitates secure contact with the user's fingers while requiring minimal grip strength.

Although in the illustrated embodiment, the horizontal plate 46 is disposed closer to the upper horizontal member 30, it can be appreciated, that the horizontal plate 46 may be disposed closer to the lower horizontal member 32 so that two of the user's fingers may be disposed above the horizontal plate 46 while a single finger may be disposed below the horizontal plate 46.

Although the handle structure 26 is shown as a U-shaped member, it is within the contemplation of the invention that the handle structure may be of various configurations. For example, the handle structure may be formed simply by joining or merging opposing relatively wide horizontal portions extending from the sidewall of the reservoir member, without the need for a definite vertical member therebetween.

Figure 3:
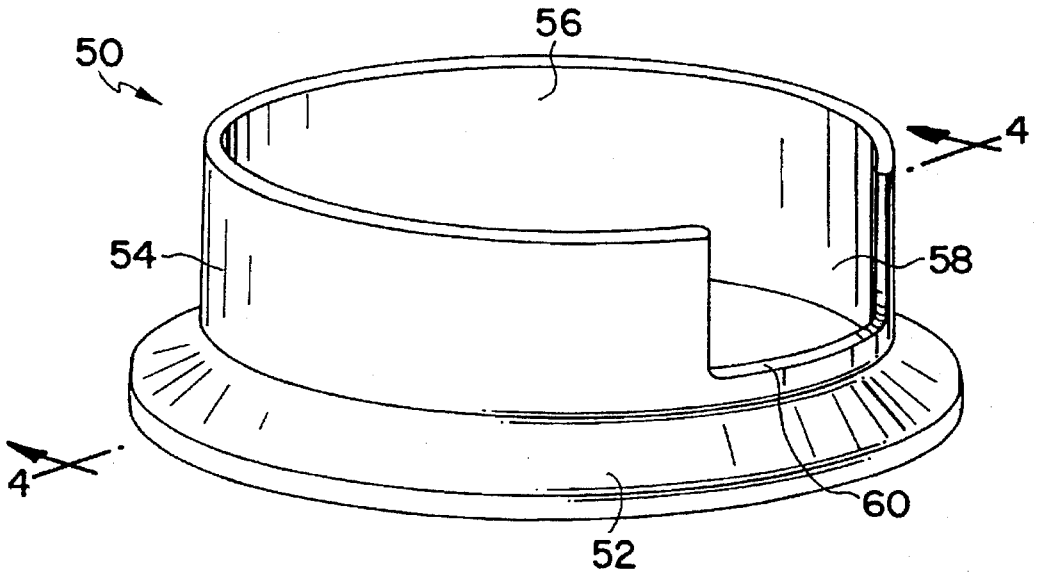
FIG. 3 is a perspective view of a cover member for the cup shown in FIG. 1.
Figure 4:
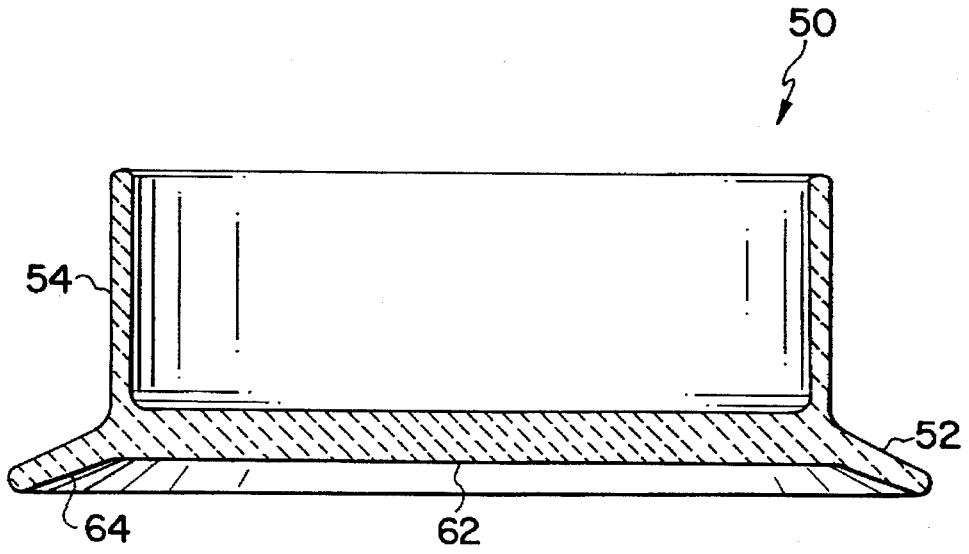
FIG. 4 is a cross-sectional view taken along the line 4—4 in FIG. 3.

As shown in FIGS. 3 and 4, a cover member, generally indicated at 50, is provided in accordance with the principles of the present invention. The cover member 50 includes a base 52 and a generally cylindrical portion 54 fixed to the base 52 at one end thereof and extending approximately 1.25 inches from the base 52. The cylindrical portion 54 has an open end 56 for receiving the reservoir portion 12 of the cup 10. Thus, the inner periphery of the cylindrical portion 54 is larger than the outer periphery of the reservoir member 12, so that a portion of the reservoir member 12 may be received in the cylindrical portion 54 of the cover member 50. The cylindrical portion 54 includes surfaces defining a notch 58 therein. The notch 58 has a width larger than a width of the horizontal members 30, 32 of the handle structure 26. As shown in FIG. 3, surface 60 defining the bottom of the notch 58 extends from the base 52 a distance approximately 0.15 inches, the function of which will become apparent below. As shown in FIG. 4, the base 54 includes a planar surface 62 surrounded by a rim 64 which tapers from the planar surface 62 so as to define a dish-shaped structure.

Figure 5:
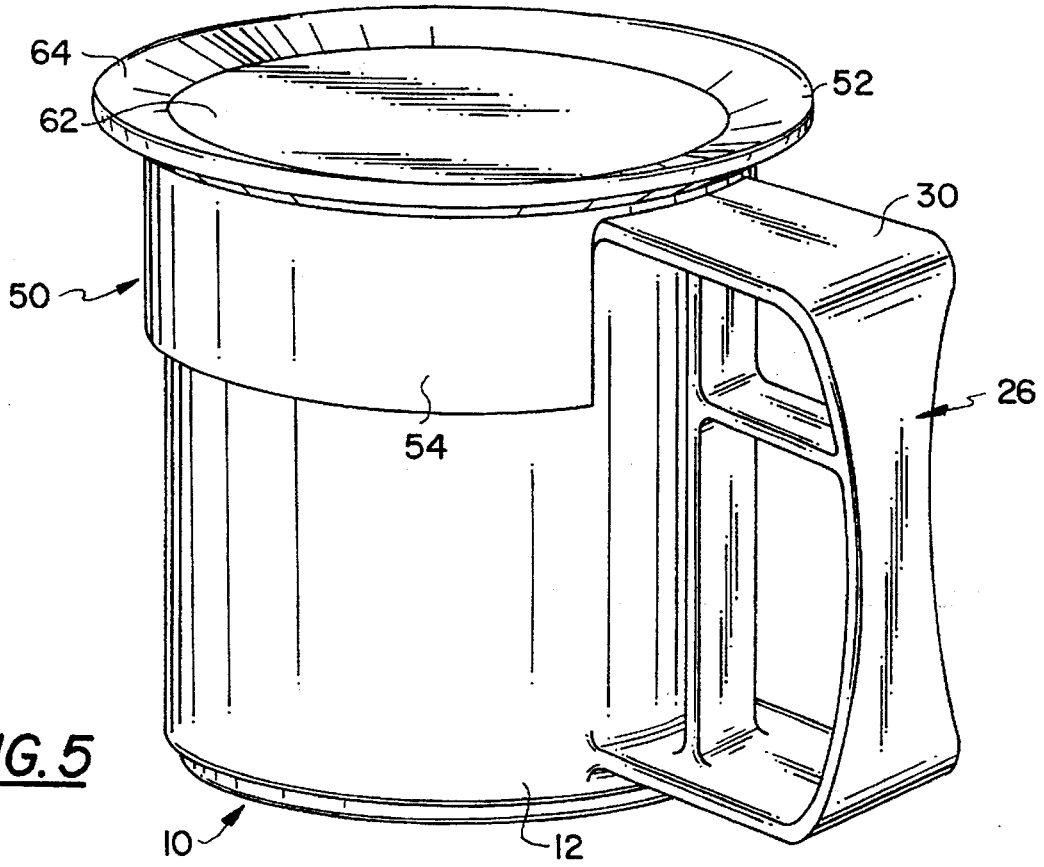
FIG. 5 is a perspective view of the cup of FIG. 1 shown with a cover member positioned over a top portion thereof.

As shown in FIG. 5, the cover member 50 is disposed over the opening 22 in the reservoir member 12. Thus, the upper horizontal member 30 extends through the notch 58 and the rim 24 of the reservoir member 12 contacts the underside of the base 52. In such a position, when the reservoir member 12 is filled with a hot liquid, the cover member 50 prevents heat exchange between the liquid and air so that the liquid remains hot for a longer period of time. Further, the planar surface 62 and rim 64 of the base 50 defining the dish-shape may be used to rest food thereon so as to be warmed by heat transfer from the liquid in the cup 10 to the base 52 of the cover member 50. To facilitate heat transfer, the reservoir member 12, handle structure 26 and cover member 50 are each composed of refractory material such as, for example, ceramic, stoneware or porcelain. However, each could be formed from other material including wood, metal or man-made materials including plastics, thermoforming or thermosetting resins.

Figure 6:
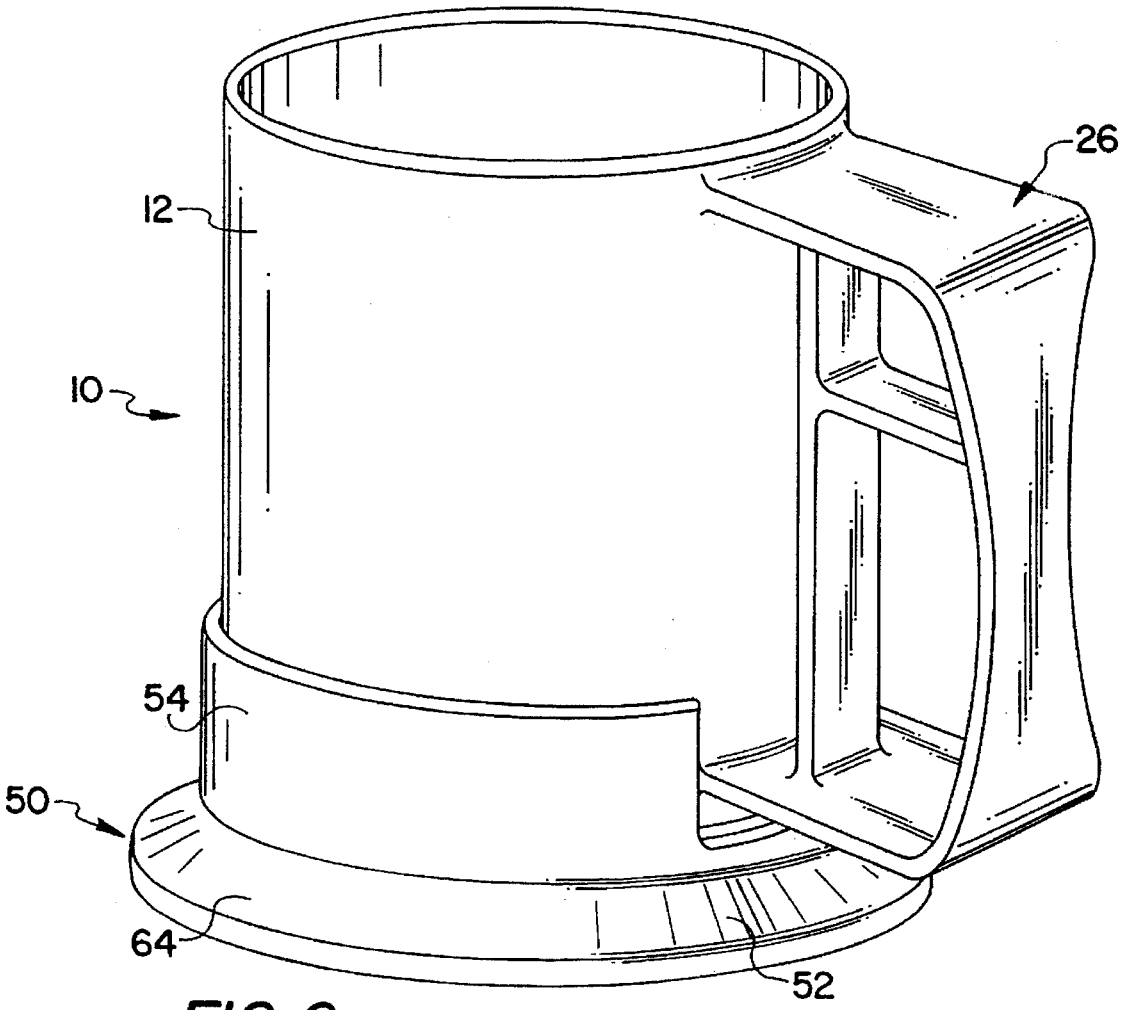
FIG. 6 is a perspective view of the cup of FIG. 1 shown with the cover member positioned under the bottom portion thereof.

As shown in FIG. 6, the cup 10 is shown placed in the cover member 50 so that the bottom surface 20 of the reservoir member 12 contacts the underside of the base 52 of the cover member 50. The surface 60 defining the bottom of the notch 58 extends from the base 52 so that if liquid within the reservoir member 12 inadvertently spills therefrom, the liquid will be contained within the cylinder portion 54 of the cover member 50. Thus, in this position, the cover member 50 functions as a coaster to contain spills.

It has thus been seen that the present invention provides a cup having an improved handle structure whereby users having disabilities may lift and balance the cup easily. Thus, regardless of how weak, inflexible or otherwise limited the user's hands may be, the cup of the invention is configured so that the weight thereof may be supported by the handle structure so that the user may simply balance and lift the cup without strain from the hands. Further, the cup provides a barrier which isolates the user's fingers from contact with the hot outer periphery of the cup containing a liquid at an elevated temperature.

While the invention has been described in connection with what is presently considered to be the most practical and preferred embodiment, it is understood that the invention is not limited to the disclosed embodiment but, on the contrary, is intended to cover various modifications and equivalent arrangements included within the spirit and scope of the appended claims.

What is claimed is:

1. A cup comprising:

a reservoir member having distal and proximal ends and an interconnecting sidewall structure, said distal end defining a closed bottom surface of said reservoir member, said proximal end defining an opening in said reservoir member, and a handle structure affixed to said reservoir member, said handle structure including:

first and second generally horizontal portions fixed to and extending outwardly from said sidewall of reservoir member, a generally vertical portion spaced from said sidewall structure so as to define at least a finger or digit receiving space and extending between and joining said first and second portions, a plate member fixed to at least one of said first and second portions, extending generally vertically along at least a substantial portion of a distance between said first and second portions and spaced from said sidewall structure so as to define an air gap therebetween, and a generally horizontal plate element coupled to and extending between said plate member and said vertical portion so as to be generally parallel to said first and second portions, wherein said reservoir member and said handle member are formed from a ceramic material so as to be a one-piece integral structure.

2. The cup as defined in claim 1, wherein said plate member is connected to each of said first and second portions.

3. The cup as defined in claim 1, wherein said plate member extends fully between said first and second portions.

4. The cup as defined in claim 1, wherein said plate member is generally parallel to said vertical portion, a lateral distance from said plate member to said sidewall structure being less than a lateral distance from said plate member to said vertical portion.

5. The cup as defined in claim 1, wherein said reservoir member is of generally cylindrical shape.

6. The cup as defined in claim 1, wherein said horizontal plate element is disposed closer to said first portion than to said second portion.

7. The cup as defined in claim 1, wherein said first and second portions extend from said sidewall structure a distance of approximately 1.5 inches.

8. The cup as defined in claim 7, wherein said first portion and said second portion each have a width of approximately 1.25 inches defining a planar surface.

9. The cup as defined in claim 1, wherein said plate member is spaced approximately 0.20 inches from said sidewall structure.

10. The cup as defined in claim 1, wherein said plate member is generally rectangular.

11. The cup as defined in claim 4, wherein a width of said vertical portion gradually tapers from each of the first and second portions toward a central portion of said vertical portion.

12. The cup as defined in claim 11, wherein said taper is defined by arcuate surfaces.

13. The cup as defined in claim 1, wherein said reservoir member and said handle structure are made from refractory material.

14. A cup comprising:

a reservoir member having distal and proximal ends and an interconnecting sidewall structure, said distal end defining a closed bottom surface of said reservoir member, said proximal end defining an opening in said reservoir member, and a handle structure affixed to said reservoir member, said handle structure including:

first and second generally horizontal portions fixed to and extending outwardly from said sidewall of reservoir member, a generally vertical portion spaced from said sidewall structure so as to define at least a finger or digit receiving space and extending between and joining said first and second portions, a plate member fixed to at least one of said first and second portions, extending generally vertically along at least a substantial portion of a distance between said first and second portions and spaced from said sidewall structure so as to define an air gap therebetween, and a generally horizontal plate element coupled to and extending between said plate member and said vertical portion so as to be generally parallel to said first and second portions, wherein said reservoir member and said handle member are formed from a plastic material so as to be a one-piece integral structure.

15. A cup in combination with a cover member, said cup comprising:

a reservoir member having distal and proximal ends and an interconnecting sidewall structure, said distal end defining a closed bottom surface of said reservoir member, said proximal end defining an opening in said reservoir member, and a handle structure affixed to said reservoir member, said handle structure including:

first and second generally horizontal portions fixed to and extending outwardly from said sidewall of reservoir member, a generally vertical portion spaced from said sidewall structure and extending between and joining said first and second portions, and a plate member fixed to at least one of said first and second portions, extending generally vertically along at least a substantial portion of a distance between said first and second portions and spaced from said sidewall structure;

said cover member comprising:

a base, a wall portion extending generally perpendicularly from said base to define an open ended receiver chamber, an inner periphery of said wall portion of said cover member being greater than an outer periphery of said reservoir member so that at least a part of said reservoir member may be received in said receiver chamber of said cover member, said wall portion of said cover member having a notch defined therein, said notch having a width larger than a width of each of said first and second portions of said handle structure, said cover member being constructed and arranged to be selectively mounted to either said distal end or said proximal end of said reservoir member, with a respective one of said first and second portions received by said notch portion and at least a portion of said reservoir member received in said receiver chamber, whereby the cover member selectively defines a lid or a saucer for the cup.

16. The combination as defined in claim 15, wherein a surface defining a bottom of said notch is spaced from said base.

17. The combination as defined in claim 15, wherein said cover member is made from refractory material.

18. The combination as defined in claim 15, wherein said base of said cover member includes a planar surface and a rim portion.

19. The combination as defined in claim 15, wherein said portion of said cover member and said reservoir member are both generally cylindrical.

* * * * *